US007311048B2

(12) United States Patent
Kopala, Jr.

(10) Patent No.: US 7,311,048 B2
(45) Date of Patent: Dec. 25, 2007

(54) PNEUMATIC TABLE ASSEMBLY

(75) Inventor: Walter W. Kopala, Jr., Corona, CA (US)

(73) Assignee: Alltrade Tools, LLC, Long Beach, CA (US)

( * ) Notice: Subject to any disclaimer, the term of this patent is extended or adjusted under 35 U.S.C. 154(b) by 317 days.

(21) Appl. No.: 10/944,147

(22) Filed: Sep. 16, 2004

(65) Prior Publication Data

US 2006/0054066 A1 Mar. 16, 2006

(51) Int. Cl.
*A47B 9/00* (2006.01)

(52) U.S. Cl. ..... 108/147; 280/47.35; 108/92

(58) Field of Classification Search ..... 248/161, 248/404, 636, 157; 206/350, 372, 373; 280/47.35, 280/47.18, 30; 182/33; 297/172, 170, 161, 297/160, 344.16; 108/147, 94, 96, 92, 189
See application file for complete search history.

(56) References Cited

U.S. PATENT DOCUMENTS 262,176 A * 8/1882 Cobb ..... 108/115
2,973,803 A * 3/1961 Mickelson ..... 297/55
3,726,393 A * 4/1973 Thompson ..... 206/378
3,788,587 A * 1/1974 Stemmler ..... 248/562
3,897,080 A * 7/1975 Isom ..... 280/47.19
4,053,028 A 10/1977 Loix
4,119,044 A * 10/1978 Hines ..... 108/27
4,122,956 A * 10/1978 Hargrove ..... 211/126.14
4,235,449 A * 11/1980 Tarran ..... 280/30
4,250,977 A 2/1981 Deli
4,258,827 A 3/1981 Klose
4,632,410 A * 12/1986 Bainbridge et al. ..... 280/32.5
4,652,003 A * 3/1987 Karashima ..... 280/166
4,844,393 A * 7/1989 Lee ..... 248/165
5,072,955 A * 12/1991 Holland et al. ..... 280/32.5
5,313,892 A 5/1994 Tice
5,540,160 A * 7/1996 Rea ..... 112/217.2
5,641,034 A 6/1997 Calmeise et al.
5,803,422 A * 9/1998 Buehler ..... 248/339
5,882,095 A * 3/1999 Green ..... 312/33
6,857,378 B2 * 2/2005 Franze et al. ..... 108/147.19
6,877,442 B2 * 4/2005 Helle ..... 108/147
6,880,835 B2 * 4/2005 Tornabene et al. ..... 280/30

* cited by examiner

*Primary Examiner*—Janet M. Wilkens
(74) *Attorney, Agent, or Firm*—Fulwider Patton LLP

(57) ABSTRACT

An adjustable table assembly incorporating pneumatics. In one aspect, the table assembly includes a table surface that is adjustable in a vertical direction and further includes wheels for transportation. In other aspects, the table assembly includes a step assembly as well as slots and magnetized compartments for receiving and storing tools.

9 Claims, 5 Drawing Sheets

PNEUMATIC TABLE ASSEMBLY

BACKGROUND OF THE INVENTION

The present invention relates generally to adjustable surfaces and more particularly, to an assembly incorporating a pneumatic device for positioning a table surface.

Tables are well known for providing working or storing services. Such apparatus are designed to provide a stable and convenient surface for a myriad of purposes and objects. We use tables at meals, during work, and for displaying items.

Various tables include mechanisms for reconfiguring the table. Clamps have been incorporated into tables for lowering and raising table surfaces. Additionally, tables can be made longer by adding sleeves or can include a first table top portion that can be angled with respect to a second table top portion.

In one particular area of use, tables in the form of work benches have been employed to hold or otherwise store tools. Conventional work benches, however, are typically stationary and have limited utility when a work project cannot be placed at or near the work bench. Rolling tool chests or table tops can be transported to the work project but are often not designed for easy access to tools or not sufficiently adjustable to provide an optimum working aid. Such apparatus also conventionally lack structure that can be reconfigured to assist an individual conducting the work project. In particular, there has been little recognition in providing means for aiding and better positioning the worker with respect to a work project.

To address the limitations that are associated with conventional tables, an adjustable table that can be transported to a work site is desirable. Also desirable is an adjustable table that provides structure that facilitates strategically positioning the worker with respect to a project or work surface.

The present invention satisfies these and other needs.

SUMMARY OF THE INVENTION

Briefly and in general terms, the present invention is directed to an adjustable table assembly. In one aspect, the adjustable table assembly is particularly useful for providing a surface for tools and other items associated with a work project.

In one embodiment, the present invention is directed towards an adjustable table assembly incorporating pneumatics. A pneumatic-based subassembly provides the table assembly with structure to conveniently lower, raise or angle a table or working surface. The table assembly can also be provided with wheels to facilitate transporting the table to a work site.

In another aspect, the table assembly embodies a base, a generally vertical member extending from the base and a table surface connected to an upper portion of the vertical member. Incorporated into the vertical member is a gas spring cylinder assembly which performs the function of a pneumatic-based assembly for adjusting the position of the table surface.

In one specific embodiment, the table assembly includes a step assembly attached to a base of the table assembly. The step assembly can be fixedly attached to the base or can alternatively, include a hinge permitting the step assembly to be rotated into and out of position.

In other aspects, a lever is provided to accomplish activating the pneumatic system and to facilitate adjusting a table surface of the table assembly of the present invention.

The table assembly is also contemplated to include magnetized holding wells suited for receiving or storing tools. Slots can also be provided for storing or hanging tools from the table surface.

Other features and advantages of the present invention will become apparent from the following detailed description, taken in conjunction with the accompanying drawings, which illustrate, by way of example, the principles of the invention.

DETAILED DESCRIPTION OF THE INVENTION

Figure 1:
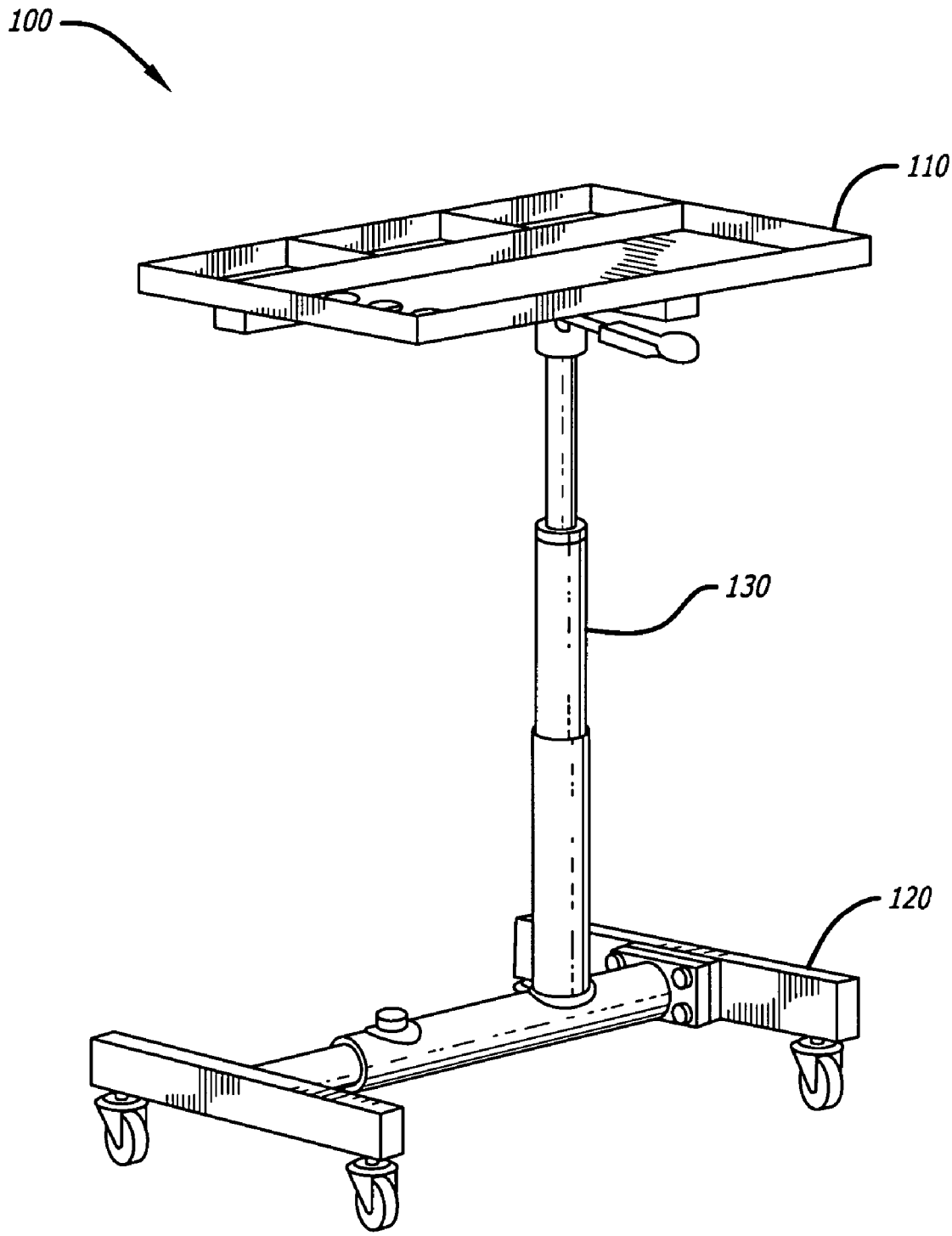
FIG. 1 is a perspective view, depicting one embodiment of a table assembly of the present invention.

Referring now to the drawings, which are provided by way of example and not limitation, there is shown various embodiments of a table assembly of the present invention. In one or more aspects, the present invention provides an adjustable table surface that can be transported to a work site. A table assembly incorporating an adjustable table surface can further include a step assembly to define an apparatus which facilitates both positioning the worker as well as tools necessary to a particular project.

Figure 2:
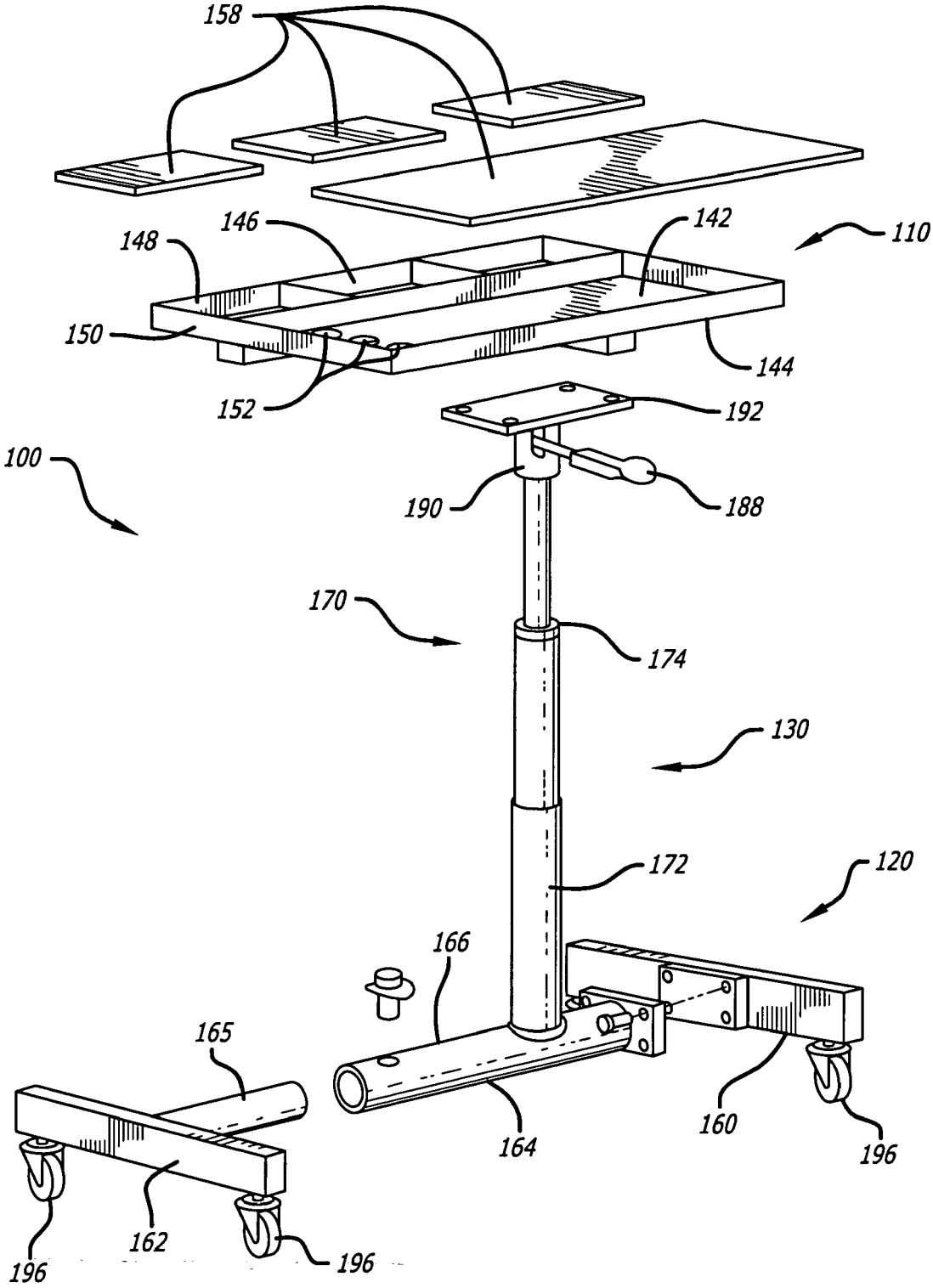
FIG. 2 is an exploded view, depicting the table assembly shown in FIG. 1.

As shown in FIGS. 1 and 2, in one embodiment, the table assembly 100 of the present invention includes an adjustable table surface 110 operatively connected to a base 120. In one aspect, the base 120 can be connected to the adjustable table surface 110 by a generally vertical member 130.

In more detail, the adjustable table surface 110 is generally rectangular and includes an upper surface 142 and a lower or bottom surface 144. The upper surface 142 defines a surface for storing or receiving items such as tools. Various compartments 146 can be formed in the upper surface 142 by walls 148 projecting generally vertically from the upper surface. Such walls 148 can extend about a perimeter 150 of the upper surface 142 as well as across the body of the rectangular upper surface 142. One or more through holes 152 can additionally be formed within the upper surface 142, the same being sized to receive specific tools or other project aids.

In order to facilitate the secure placement of for example, metal tools on the upper surface, one or more of the compartments 146 formed by the walls 148 can be magnetized. Magnetization can be accomplished by affixing magnets below the various compartments. In one particular embodiment, such magnets are contemplated to be affixed to the underside 144 of the table surface 110. In further aspects, rubber mats 158 can line the compartments 146.

The base 120 can assume many forms. In the embodiments shown in FIGS. 1 and 2, the base 120 is defined by a first bar 160 connected to a second bar 162 by a tube assembly 164. When assembled, these components define an I-formation. The tube assembly 164 further includes a male component 165 that is attached to a female component 166 by conventional means such as a bolt. Bolts or other conventional means can also be used to attach the female component to the first bar 160 and the male component 165 is welded or otherwise affixed to the second bar 162.

The base 120 is further contemplated to include structure for conventionally moving the table assembly 100 to a work site. Thus, in one particular embodiment, wheels 196 are attached to the first and second bar members 160, 162. Projecting vertically from the female component 166 of the tube assembly 164 of the base 120 is the generally vertical member 130. The vertical member 130 includes a telescoping assembly 170 formed from tubular members. A first tube 172 is connected directly to the base 120 and forms columnar support for a pneumatic base sub-assembly 174. When connected to the table surface assembly 110, the pneumatic sub-assembly 174 provides a system for raising or lowering the table surface 110. It is to be recognized, however, that other equivalent structure can be employed to accomplish adjustment of the table surface. The present invention also contemplates providing pneumatics or other approaches to both angling as well as vertically translating a table assembly.

Figure 3:
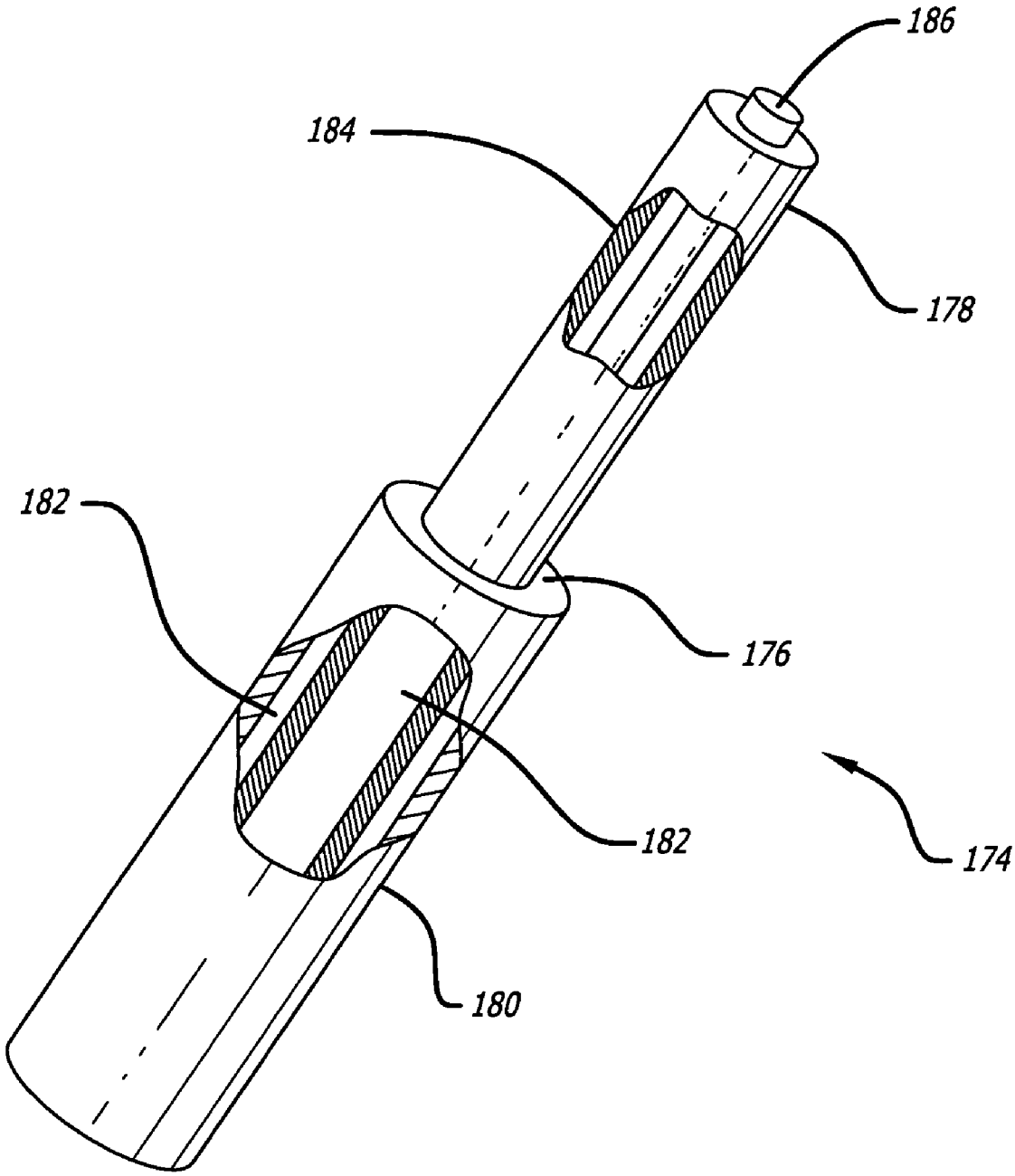
FIG. 3 is a partial cross-sectional view, depicting a pneumatic assembly of the table assembly shown in FIG. 1.

As shown in more detail in FIG. 3, the pneumatic sub-assembly 174 can be embodied in a gas spring cylinder assembly 176. Various conventional approaches can be used in the structure of the gas spring cylinder assembly. In principle, the gas spring cylinder assembly 176 includes a first tube 178 placed within and in a telescoping arrangement with respect to a second tube 180.

Chambers 182 formed within the gas spring assembly 176 are provided in combination with a gas lift support tube 184 as well as various valves and seals to accomplish the transfer of gas within the assembly to support and maintain a selected positional interrelationship between telescoping first and second tubes 178, 180. A terminal end of the first tube 178 is equipped with a release button 186 which provides means for controlling the flow of gas within the assembly and to facilitate changing the relational positions of the first and second tubes 178, 180.

As shown in FIG. 2, the release button 186 of the pneumatic sub-assembly 174 can be attached to a lever 188. The lever 188 can be affixed to the terminal end of the pneumatic sub-assembly 174 via a collar 190. The collar 190 in turn can be attached to an affixing plate 192 which is utilized to attach the vertical member 130 to the underside of the adjustable table surface 110. Thus, actuation of the lever accomplishes raising and lowering the table surface 110 with respect to the base 120.

Figure 4:
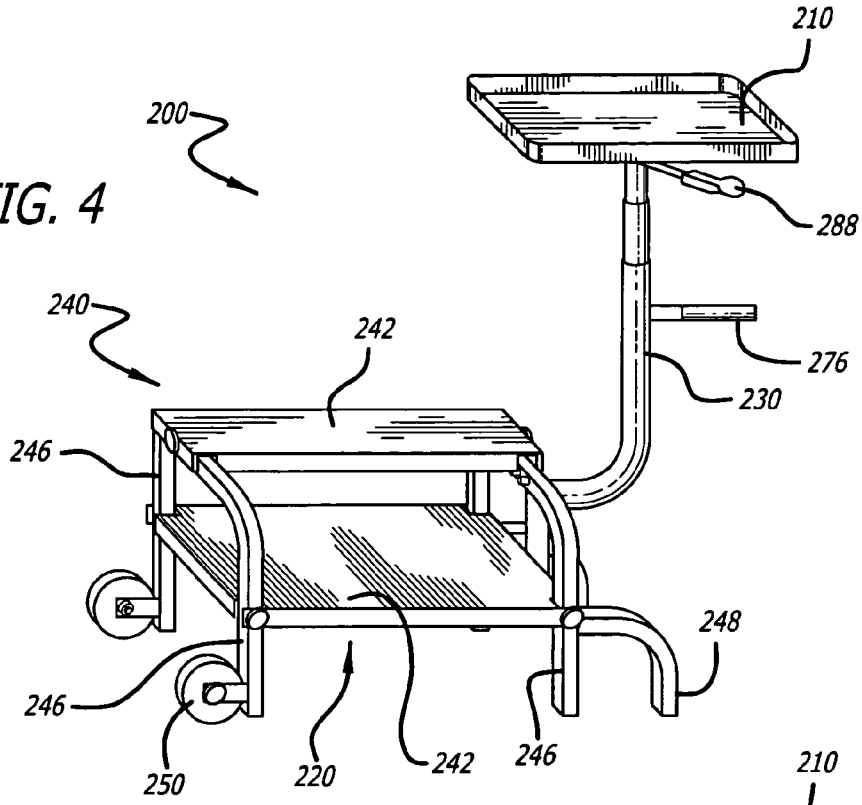
FIG. 4 is a perspective view, depicting another embodiment of a table assembly of the present invention.
Figure 5:
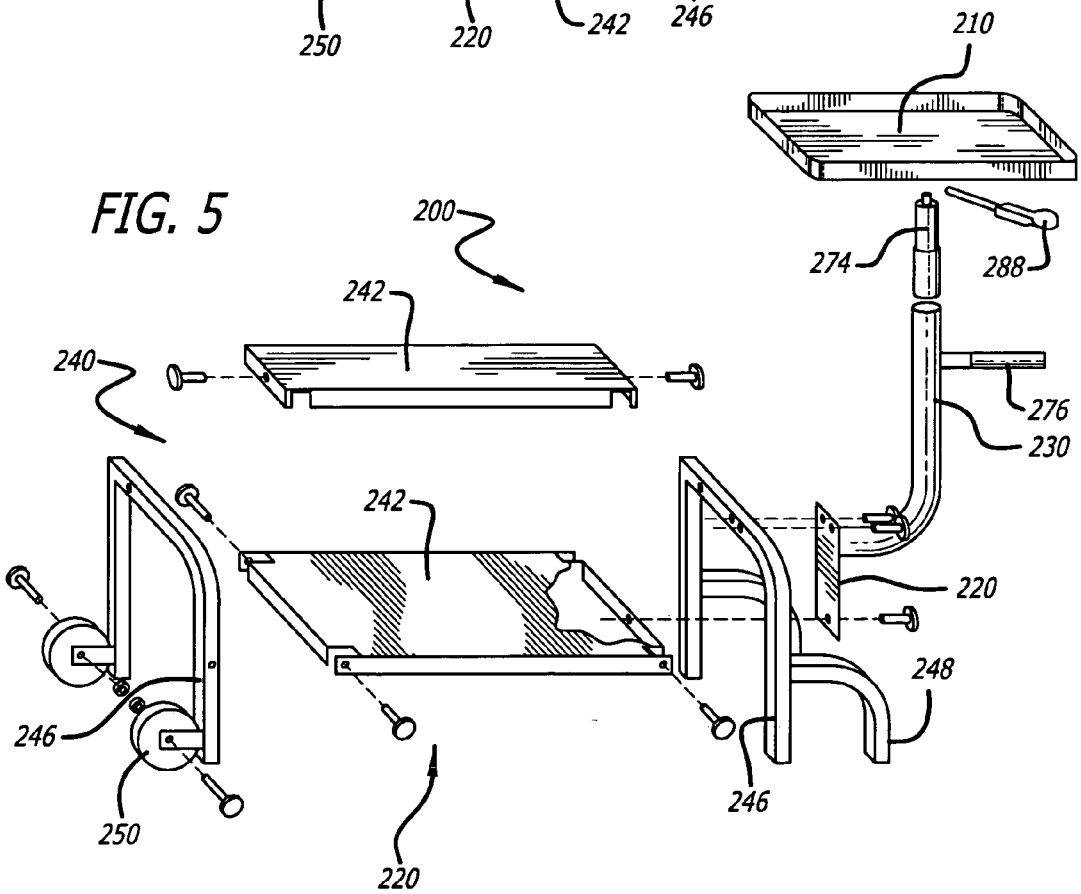
FIG. 5 is an exploded view, depicting the table assembly shown in FIG. 4.

Referring now to FIGS. 4 and 5, there is shown an alternate embodiment of a table assembly 200 of the present invention. The table assembly 200 includes an adjustable table surface 210 and a base 220. Connecting the table surface 210 to the base assembly 220 is an extender assembly 230.

As before, the adjustable table assembly 210 can assume a generally rectangular configuration, although for each of the embodiments, various shapes are contemplated. Moreover, the adjustable table surface 210 can include an upper surface with compartments and slots formed therein. The compartments can be magnetized as described.

In one aspect, the base 220 of the adjustable table assembly 200 includes a step assembly 240 including one or more steps 242. Each step 242 defines a platform for standing or positioning oneself with respect to a work project.

The base 220 is further provided with a plurality of legs 246, 248 for stability. One pair of legs 248 extends laterally from the base 220 and under the adjustable table surface 210. Two additional pairs of legs 246 project directly below the step 242 of the step assembly 240. The legs can further be equipped with wheels 250. In the embodiment shown, a rotatable wheel 250 is attached to a side surface of each leg 246 to thereby provide the table assembly 200 with a rolling function when the table assembly is tilted toward its side. Such an arrangement is beneficial as the stairs and legs provide a stable platform for standing, yet the table assembly 200 can be transported to a work site via the wheels.

The extender assembly 230 defines a J-formation, the top of the assembly being attached to the adjustable table surface 210 and a lower section being affixed to the base 220. The approach to assembling and attaching these structures together is generally the same as outlined above with respect to the embodiments shown in FIGS. 1 and 2. Further, like the generally vertical member 130, the extender member 230 also includes a pneumatic sub-assembly 274 and a lever 288 for actuation of the same. The extender assembly 230 further includes a handle 276 for tilting the table assembly 200 on the wheels 250 for transportation. When in its assembled form, the step assembly 220 is laterally displaced from the table surface assembly 210 for the added convenience of being able to easily remove and replace items such as tools within and upon the table assembly 200.

Figure 6:
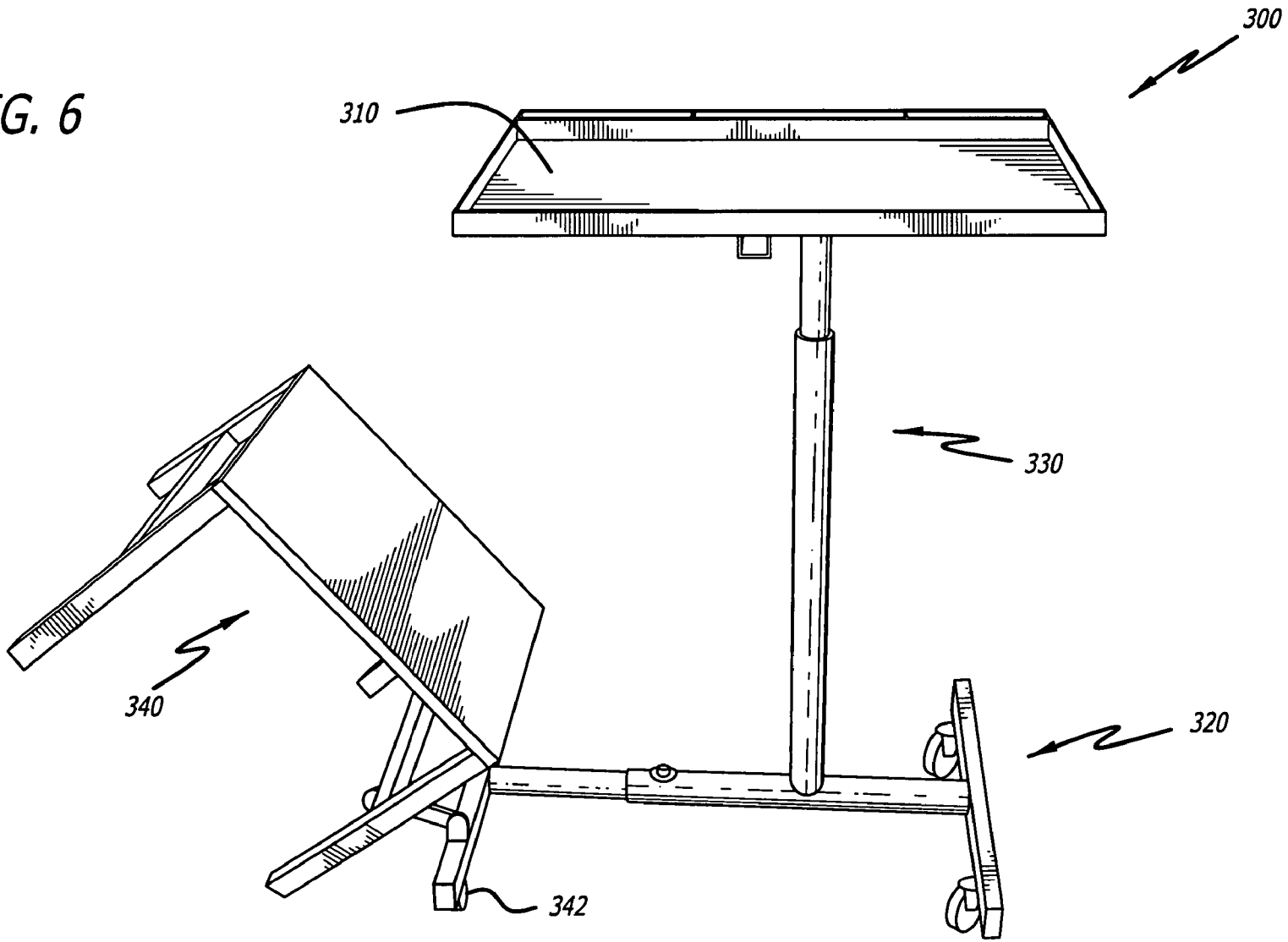
FIG. 6 is a perspective view, depicting yet another alternative embodiment of a table assembly of the present invention.

In yet another embodiment (FIG. 6), the table assembly 300 combines features of the previously described embodiments. It is to be recognized that the structure and features of each of the disclosed embodiments can be incorporated into other of the embodiments. In one particular aspect, the table assembly 300 includes an adjustable table surface 310 connected to a rolling base 320 by a generally vertical member 330. A stair assembly 340 is rotatably attached via conventional approaches to the base 320. Other approaches of attaching the stair assembly 340 to the table assembly 300 can also be contemplated such as rails for sliding the stairs into and out of position.

When folded against the vertical member 330 of the table assembly 300, the stair assembly 340 is tucked away so that the table assembly 300 can be transported along wheels 342. When rotated away from the vertical member 330, the stair assembly is laterally displaced from the adjustable table surface 310.

Accordingly, the present invention provides an adjustable table that can be transported to a work site. The adjustable table of the present invention also provides shorter facilitating strategies positioning both a worker as well as work items with respect to a project or work surface.

Thus, it will be apparent from the foregoing that, while particular forms of the invention have been illustrated and described, various modifications can be made without parting from the spirit and scope of the invention.

I claim:

1. A table assembly, comprising:

a base, the base including a total of six legs supporting the base on a floor surface, a first group of four legs on a first side of the base and a second group of two legs on a second side of the base, only each of the second group of two legs being configured with wheels;

a table surface;

a single L-shaped member having a first and a second end, the first end connected to the second first of the base and the second end connected to the table surface so that the table surface is laterally displaced from the base;

a pneumatic sub-assembly incorporated into the L-shaped member;

a handle extending generally perpendicular to a vertical portion of the L-shaped member;

a lever for actuating the pneumatic sub-assembly; and a step assembly, the step assembly incorporated into the base;

wherein the handle is employed to tilt the table assembly on the wheels.

2. The table assembly of claim 1, further comprising a plurality of compartments for storing tools.

3. The table assembly of claim 2, wherein the plurality of compartments are formed in the table surface.

4. The table assembly of claim 2, wherein at least one of the plurality of compartments is magnetized.

5. The table assembly of claim 1, further comprising at least one through hole formed in the table surface.

6. The table assembly of claim 5, wherein the through hole is configured to accept a tool.

7. The table assembly of claim 1, wherein the pneumatic sub-assembly is a gas spring cylinder assembly.

8. The table assembly of claim 1, wherein the step assembly includes at least one step.

9. The table assembly of claim 1, wherein the table surface includes a perimeter and a sidewall extending along the perimeter and above a plane occupying the table assembly.

* * * * *